US005749416A

United States Patent [19]

Belcher

[11] Patent Number: 5,749,416

[45] Date of Patent: May 12, 1998

[54] DOWNHOLE PUMP DRIVE HEAD ASSEMBLY

[75] Inventor: Iain Russell Belcher, Timperley, United Kingdom

[73] Assignee: Mono Pumps Limited, United Kingdom

[21] Appl. No.: 787,204

[22] Filed: Jan. 22, 1997

Related U.S. Application Data

[63] Continuation-in-part of Ser. No. 613,158, Mar. 8, 1996, abandoned.

[30] Foreign Application Priority Data

Apr. 10, 1995 [GB] United Kingdom ..... 9507396

[51] Int. Cl.[6] ..... E21B 43/00; F16D 9/10

[52] U.S. Cl. ..... 166/68.5

[58] Field of Search ..... 166/68, 68.5, 165, 166/117.7

[56] References Cited

U.S. PATENT DOCUMENTS

| | | | |
|---|---|---|---|
| 3,447,650 | 6/1969 | Dossier . | |
| 3,585,473 | 6/1971 | Huxtable . | |
| 4,314,487 | 2/1982 | Ahlen . | |
| 4,320,799 | 3/1982 | Gilbertson . | |
| 4,372,379 | 2/1983 | Kulhanek et al. | 166/68.5 |
| 4,687,085 | 8/1987 | Shimizu et al. . | |
| 4,716,961 | 1/1988 | Makins et al. | 166/78.1 X |
| 5,143,153 | 9/1992 | Bach et al. | 166/68.5 |
| 5,257,685 | 11/1993 | Tichiaz et al. . | |
| 5,327,961 | 7/1994 | Mills . | |
| 5,358,036 | 10/1994 | Mills . | |
| 5,370,179 | 12/1994 | Mills | 166/68.5 |
| 5,573,063 | 11/1996 | Morrow . | |

*Primary Examiner*—Roger J. Schoeppel
*Attorney, Agent, or Firm*—Harness, Dickey & Pierce, P.L.C.

[57] ABSTRACT

A downhole pump drive head assembly for driving the rod string which rotates the rotor of a downhole pump, includes a body 12 provided with upper and lower bearings 14,16, in which is rotatably mounted a drive shaft 22, which carries, for rotation therewith, a polish rod 20 of the rod string. A hydraulic retarder 28 is mounted on the body 12 and includes a stator turbine 30, and a rotor turbine 32, the rotor turbine being mounted with respect to the shaft 22, for example by means of a free wheel mechanism 42.

The hydraulic retarder, therefore, operates to control rotation and prevent back-spin of the rod string.

10 Claims, 3 Drawing Sheets

DOWNHOLE PUMP DRIVE HEAD ASSEMBLY

CROSS REFERENCE TO RELATED APPLICATION

This application is a continuation-in-part of U.S. patent application, Ser. No. 08/613,158, filed Mar. 8, 1996, now abandoned, which claimed priority on United Kingdom Application No. 9507396.1.

The present invention relates to a downhole pump drive head assembly for driving the rod string which rotates the rotor of a downhole pump.

Such downhole pumps which are extensively used in the oil industry for operating low pressure oil wells and also used for raising water, are often mounted several hundred meters or indeed a number of kilometers below the surface. Because of the difficulties of mounting the submersible pump at such low levels which employ an electric motor drive at the lower level, it has become practice to drive the rotor of such pumps by means of a rod string which comprises a series of rods connected end to end extending from the surface down to the rotor. Of course such rod strings must themselves be very long.

If one is using a pump of the helical gear variety with a cooperating male and female stator and rotor, the stator is traditionally suspended on a string of tubing which hangs inside the well casing and the rod string connected the rotor to the drive head. Thus the drive head transmits the rotor motion via the rod string and experience has shown that the upper end of the rod string can rotate up to a hundred times in a one thousand meter well before the rotor at the bottom of the well starts to turn.

Now if there is interruption in the power supply, or the pump has to be switched off for maintenance, then there will be a tendency for so-called "back-spin". This is a combination of two factors. Firstly, the built up torsional energy in the rod string resulting from the twisting referred to above, and this makes the rod string act like a powerful torsion spring and will rotate the string backwards with rapid acceleration. Secondly, the fluid head above the pump will have a tendency to flow back down through the pump and in many pump assemblies this will cause the rotor to rotate backwards in the stator.

It will be appreciated that unless some means are provided to prevent this, the rod string can reach very high speeds. Clearly the danger of these high speeds are:

a) pulleys at the drive head can exceed their maximum design speed and can then explode. Instances have occurred where fragments of pulleys have been found four hundred meters away from the well after a pulley explosion.

b) the so-called polish rod which is at the upper end of the rod string protrudes above the drive head will have a tendency to bend over during back-spin and can have a very damaging scything effect to any nearby obstructions.

c) electric drive motors run backwards at high speed and can be damaged.

d) vibration during back-spin can cause damage to the drive and to the support structure.

Various proposals have been made to overcome this problem. The first of these is a disc brake mounted horizontally on top of the well drive head. Hydraulic pressure supplied in a conventional way to brake the gear pump is caused to be operated by the reverse rotation of the drive head. When the pressure reaches a high enough level to stop the disc from rotating, the gear pump stops rotating as well, and the pressure falls by releasing the disc again. In this way, during operation, the disc brake operates through a stop/slip/stop/slip cycle. While such an arrangement is reasonably satisfactory, the disc brakes are found to wear, the disc gets very hot and this is even been to such an extent to cause a fire, when oil has leaked from the disc brake caliper onto the hot disc.

Part of the problem here is that the disc is often stationary and does not get air cooled as with an automotive disc brake. Additionally the external pipe-work is found to be liable to be damaged and gives rise to brake failure.

A second proposal has been the use of a vane pump in which a cam shaped rotor is provided with spring loaded vanes. The rotor rotates within a rounded triangular housing. Oil contained in the brake is swept by the vanes into a smaller volume thereby increasing the pressure and resisting movement. The oil leaves the housing via restriction holes at the end of the housing chamber. The major problem here is that the oil gets hot and degrades, and there is a build up of heat which can lead to failure of the vanes within the rotor, which are usually formed of nylon.

The next proposal has been to use a hydraulic motor in which the hydraulic motor and power pack control back-spin controlling the flow of oil as the motor spins backwards in the pump. A problem here is that the motor can lose suction when acting as a pump and fail as a brake. Furthermore, oil can get hot in the hydraulic power pack and the hydraulic systems generally tend to require high maintenance.

A further proposition has been to use electric motor brakes/mechanical centrifugal brake. These have traditionally not been fitted onto the main drive shaft. If a belt fails then the main shaft would not be connected to the brake. This system can only be used on electric motor applications and there is no control of back-spin speed.

A final earlier proposition has been a band brake in which a band is tightened onto a drum using a setting bolt. When the drive head attempts to back-spin, a sprag clutch engages the drum and the drive head is stopped from rotating backwards. Stored energy is released by manually loosening the setting bolt until the drum rotates a reasonable speed.

The main disadvantage here is that torque remains stored in the rod string and the system can be potentially dangerous if the band is released sufficiently to allow back-spin at too high a speed.

It is now proposed, according to the present invention, to provide a downhole pump drive head assembly for driving the rod string which rotates the rotor of a downhole pump, said assembly comprising a frame, a bearing assembly mounted to said frame, a drive shaft rotatably supported in said bearing assembly for rotation about a vertical axis, means on said drive shaft for drivingly engaging the upper rod of said rod string, a body surrounding said bearing assembly, a hydraulic retarder associated with said body, said hydraulic retarder comprising a retarder housing, a retarder stator turbine affixed within said housing, a retarder rotor turbine operatively connected to said drive shaft within said housing and closely adjacent said retarder stator turbine, one another and a means operatively connecting said retarder turbine rotor to said drive shaft, the retarder being effective to brake rotation of said drive shaft in one direction of rotation of said drive shaft only, but allowing relative rotation therebetween in the opposite direction of rotation of said drive shaft.

Such a system can be designed for maximum braking torque at 100% slip and this has the advantage that the retarder can have a relatively small rotor/stator size. Such a retarder system naturally circulates oil through the retarder stator and this enlarges the heat capacity by utilizing oil from the transmission.

The system therefore produces wear free braking, with no fading of brake torque. The system is inherently safe because the larger the speed, the higher the braking torque. The system can have unlimited life without any significant maintenance at all, apart, perhaps, from the need to replace the transmission oil from time to time, during normal scheduled maintenance, i.e. not due solely to back-spinning.

In order that the present invention may more readily be understood, the following description is given, merely by way of example, reference being made to the accompanying drawings in which.

Figure 1:
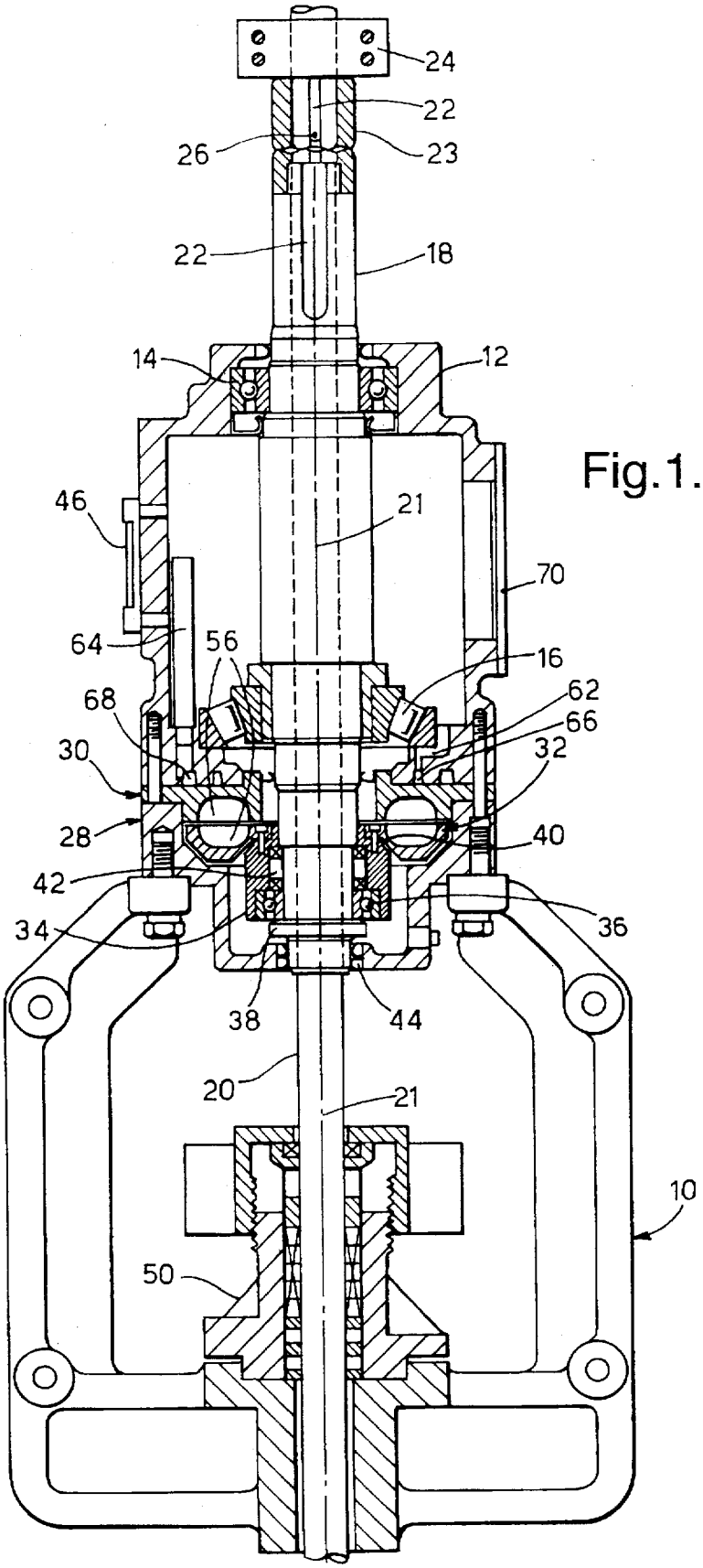
FIG. 1 is a cross-section through one embodiment of downhole pump drive head assembly according to the invention.

Reference is now made to FIG. 1 in which the drive head assembly includes a lower frame 10 upon which is mounted a hollow body indicated by the general reference numeral 12. Within this is an upper roller bearing 14 and a lower taper roller bearing 16 which together mount a vertically extending drive shaft 18. This drive shaft is hollow and accommodates the upper rod, known as a polish rod 20 of a rod string which extends downwardly into a well bore and drives the rotor of a deep bore hole pump. At its upper end the rod 20 is provided with a key and key slot 22 which connects it for driving rotation to a stub shaft 23. Support for the polish rod 20 is provided by a conventional polish rod clamp 24 which is secured by means illustrated schematically at 26 to the upper end of the polish rod 20.

The lower part of the body 12 comprises a retarder housing 28, to which is affixed a retarder stator turbine 30 which is coaxial with the axis 21 of a drive shaft 18 and a polish rod 20.

Also mounted coaxially within the retarder housing 28 is a retarder rotor turbine 32, which is secured to a rotatable carrier 34, supported on an additional ball bearing arrangement 36, held in position by a lock nut 38. The retarder rotor turbine 32 is secured by means of bolts 40 to the rotatable carrier 34.

Mounted within and secured to the carrier 34 is a braking system 42, which is also secured to the drive shaft 18. This provides a conenction between the drive shaft and the carrier 34. The configuration of the retarder, as explained below, is such as to retard or brake the drive shaft in one direction of rotation only, but allow rotation of the drive shaft in the other normal operating direction.

At the bottom of the retarder housing 28 there is provided a rotating shaft lip seal 44.

The housing is filled with a relatively thick transmission oil and the level of this can be observed through an oil level gauge 46.

Within the frame 10, below the retarder housing 34, there is mounted a gland assembly 50.

Figure 2:
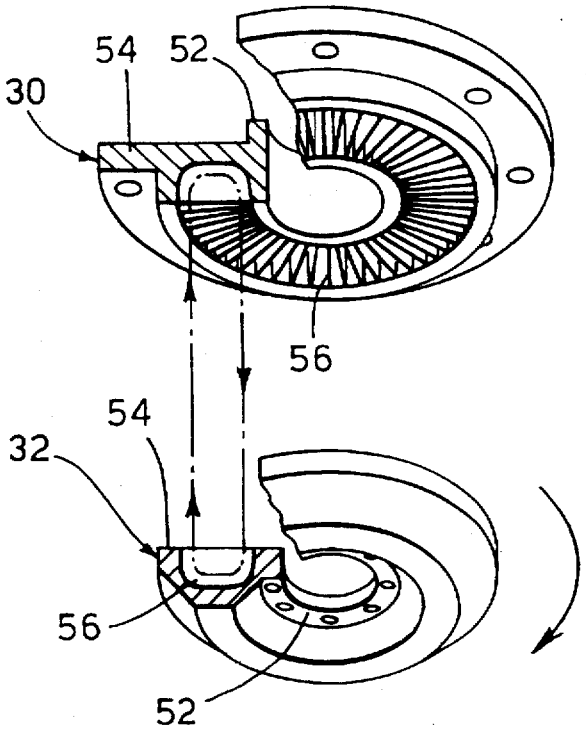
FIG. 2 is a schematic perspective view illustrating the retarder rotor and stator turbines.

If reference is now made to FIG. 2, it can be seen that the hydraulic retarder is illustrated schematically and that the retarder stator turbine 30 and the retarder rotor turbine 32 each comprise a hub 52, a circumferential ring 54 and generally radially extending vanes 56.

The path of the hydraulic transmission oil is indicated by the reference numeral 60. The angle of the blades of both the rotor and the stator are chosen to produce, upon relative rotation of the relative turbine with respect to the stator turbine, the maximum possible braking force. The transmission oil is retarded by the stator and is accelerated in both the radial direction and in the circumferential direction by the rotor turbine. In this way, the kinetic energy provided by the rotating turbine is transformed into heat. If so desired, the braking effect can be altered by controlling the quantity of transmission oil within the retarder.

Reverting to FIG. 1, there can be seen an oilway 62 below the bearing 16. In fact there will normally be three or four such oilways connecting the lower part of the body 12 to the upper part of the retarder 28, so that oil can flow downwardly from the interior of the body 12 into the retarder. Within the body 12 there is also shown an upstanding return or circulating tube 64. Again there will be usually three or four such tubes extending upwardly and it can be seen that the oilways 62 are connected to an inner annular groove 66 and the circulating tubes 64 are connected to an outer annular groove 68 so that oil is fed evenly to the retarder from the groove 66 and is returned evenly from the retarder via the groove 68 to the tube or tubes 64.

Pressure produced by the rotor turbine 32 will cause oil to flow into groove 68 and then up the tube or tubes back into the interior of the body 12, thereby providing thorough mixing of the transmission oil therein and facilitating cooling thereof.

If desired, an external oil cooling system could be provided whereby the oil is pumped either by the action of the rotor turbine 32, or by a supplementary oil pump so that oil is pumped outwardly through a conventional oil cooler radiator system.

It is also contemplated that a control facility could be provided to control the volume of flow of oil to the retarder to control the braking effect produced thereby.

It will be appreciated, therefore, that with the structure of the present invention a very efficient braking effect can be achieved and this can be controlled accurately and requires no maintenance and there is no wear, thus providing very distinct advantages over what can be achieved with previous arrangements of this general type.

In the construction illustrated, drive is provided via the stub shaft 23 which is arranged vertically.

It will be noted that that body 12 has a plate 70 indicated on the right hand side in FIG. 1. This plate 70 may be removed and the opening thereof used for the passage of a horizontally extending input shaft (not shown) and a suitable gearing, e.g. bevel gearing or a worm and pinion arrangement, could be provided to connect this horizontal input shaft to the drive shaft 18. It is contemplated that one could then either mount the retarder 28 as shown, or mount the retarder externally on the horizontal input shaft so that the axis of the retarder itself will be horizontal.

Figure 3:
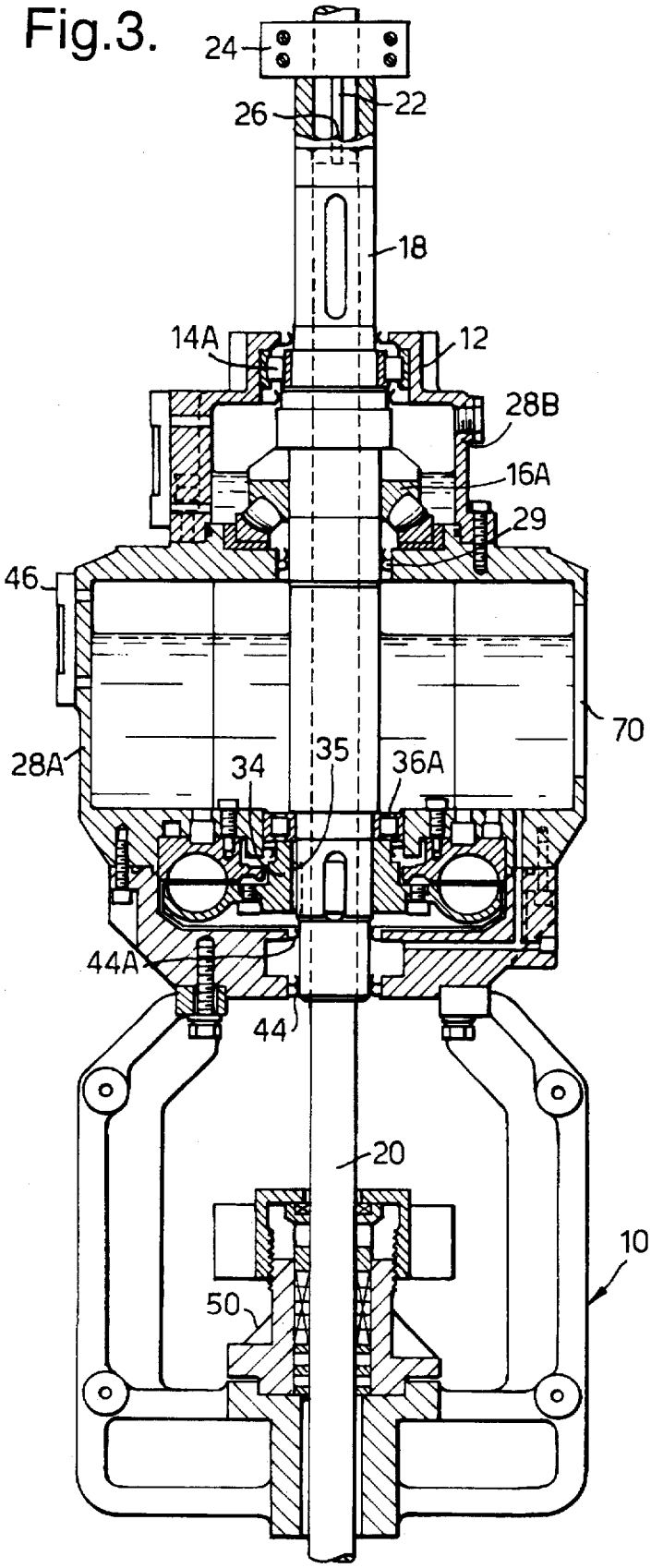
FIG. 3 is a view similar to FIG. 1 of a second embodiment of down hole pump drive assembly according to the invention.

FIG. 3 shows a further embodiment of the invention in which like parts have been indicated by like reference numerals. However, as is clearly shown in FIG. 3, no free wheel is provided and the retarder turbine carrier 34 is keyed at 35 directly to the drive shaft 18. The configuration of the turbines 30 and 32 is such that rotation in one direction only causes a braking effect, but practically no free rotation is allowed in the opposite direction.

In the structure of FIG. 1, the hydraulic transmission oil which is used in the retarder 28 is also used as a bearing oil for the bearing 16, and also, to a certain extent, for the bearings 14 and 36.

Now it has been found that this is not always satisfactory because the characteristics of the oil which is used for operating the retarder 28 does not necessarily act very well as a lubricating oil for the bearing.

In FIG. 3, therefore, a structure is shown in which two different oils can readily be used. Instead of having a single retarder housing 28, there is a lower retarder housing 28A which acts as a reservoir for the transmission oil used in the retarder, and there is an upper retarder housing 28B mounted immediately below the upper roller bearing 14A. At the lower part of this upper housing 28B is mounted a taper roller thrust bearing 16A and lip seals 29, or other suitable seals, prevent bearing oil enclosed in the housing 28B, to lubricate the thrust bearing 16A, from leaking into the lower housing 28A. A lower radial roller bearing 36A is provided immediately below the reservoir provided within the housing 28A and the transmission oil enclosed in this housing can be used as the lubricating oil for this lower bearing.

It will be noted that two sets of seals 44 (as in FIG. 1) and 44A are provided in contact with the drive shaft 18.

I claim:

1. A downhole pump drive head assembly for driving the rod string which rotates the rotor of a downhole pump, said assembly comprising a frame, a bearing assembly mounted to said frame, a drive shaft rotatably supported in said bearing assembly for rotation about a vertical axis, a driving connection between said drive shaft and an upper rod of said rod string drivingly engaging the upper rod, a body surrounding said bearing assembly, a hydraulic retarder associated with said body, said hydraulic retarder comprising a retarder housing, a retarder stator turbine affixed within said housing, a retarder rotor turbine operatively connected to said drive shaft within said housing and closely adjacent said retarder stator turbine, said stator and rotor turbines being mounted coaxially With one another and an operative connection between said retarder turbine rotor and said drive shaft, the retarder being effective to brake rotation of said drive shaft in one direction of rotation of said drive shaft only, but allowing relative rotation therebetween in the opposite direction of rotation of said drive shaft.

2. A downhole drive pump assembly as claimed in claim 1, wherein said hydraulic retarder is mounted within said body and wherein said retarder stator and rotor turbines are mounted coaxially with said vertical axis.

3. A downhole pump drive assembly as claimed in claim 1, and further comprising an input shaft extending horizontally and a gear arrangement connecting said input shaft to said drive shaft.

4. A downhole pump drive assembly as claimed in claim 3, wherein said retarder housing surrounds said input shaft and said retarder rotor is coaxially connected to said input shaft.

5. A downhole pump drive assembly as claimed in claim 1, wherein said means on said drive shaft for drivingly engaging the upper rod of said rod string comprise a stub shaft mounted coaxially above said drive shaft, means securing said upper rod to said stub shaft, and rotation engaging means between said upper rod and said drive shaft.

6. A downhole pump drive assembly as claimed in claim 1, wherein said bearing assembly comprises an upper bearing adjacent the upper end of said body, a lower bearing mounted within said body intermediate the ends thereof.

7. A downhole pump drive assembly as claimed in claim 1, wherein a free wheel is operatively connected between said retarder turbine rotor and said drive shaft.

8. A downhole pump drive assembly as claimed in claim 7, and further comprising an additional bearing, adjacent said free wheel, rotatably supporting said retarder rotor turbine.

9. A downhole pump drive assembly as claimed in claim 1, and further comprising at least one upstanding tube extending into said retarder housing and at least one downwardly extending oilway connected to the lower part of said retarder housing whereby oil from said retarder housing flows to said retarder through said at least one oilway and is returned to said housing by pressure induced by said retarder rotor turbine back through said at least one vertically extending tube.

10. A downhole pump drive assembly as claimed in claim 1, wherein said housing comprises a lower housing and an upper housing, said lower housing forming a reservoir for transmission oil for said hydraulic starter and wherein said upper housing is not connected to said lower housing, and wherein said bearing assembly comprises an upper radial bearing located in said upper housing, an axial thrust bearing located in said upper housing and a lower radial bearing mounted at the lower end of said lower housing, said upper housing being effective to accommodate bearing oil for said upper axial thrust bearing.

* * * * *